US006632119B2

(12) United States Patent
Chernek et al.

(10) Patent No.: US 6,632,119 B2
(45) Date of Patent: Oct. 14, 2003

(54) WINDING DEVICE AND ORNITHOPTER UTILIZING SAME

(75) Inventors: Frank S. Chernek, Yuma, AZ (US); Charles Kownacki, Erie, PA (US)

(73) Assignee: Marvel Enterprises, Inc., New York, NY (US)

( * ) Notice: Subject to any disclaimer, the term of this patent is extended or adjusted under 35 U.S.C. 154(b) by 0 days.

(21) Appl. No.: 09/797,175

(22) Filed: Mar. 1, 2001

(65) Prior Publication Data

US 2002/0065015 A1 May 30, 2002

Related U.S. Application Data

(60) Provisional application No. 60/186,118, filed on Mar. 1, 2000.

(51) Int. Cl.[7] ..... A63H 27/00
(52) U.S. Cl. ..... 446/35; 244/72; 446/59
(58) Field of Search ..... 446/34, 35, 59, 446/60, 57, 308, 309; 244/11, 22, 72

(56) References Cited

U.S. PATENT DOCUMENTS

| | | | | | |
|---|---|---|---|---|---|
| 262,686 | A | | 8/1882 | Myers | |
| 829,660 | A | * | 8/1906 | Lewkowicz | 446/35 |
| 1,031,623 | A | | 7/1912 | De 'Redon de Colombier | |
| 1,076,644 | A | * | 10/1913 | Quick | 244/233 |
| 1,287,779 | A | * | 12/1918 | Springer | 446/309 |
| 1,936,072 | A | * | 11/1933 | Roderick | 185/37 |
| 2,457,281 | A | | 12/1948 | Shannon | |
| 2,504,567 | A | * | 4/1950 | Morgan | 446/18 |
| 2,763,348 | A | | 9/1956 | Corbitt et al. | |
| 2,814,907 | A | | 12/1957 | Sears | |
| 3,626,555 | A | * | 12/1971 | Albertini | 446/35 |
| 4,155,195 | A | * | 5/1979 | Leigh-Hunt | 244/11 |
| 4,195,438 | A | * | 4/1980 | Dale et al. | 446/35 |
| 4,318,455 | A | | 3/1982 | Lapierre | |
| 4,591,346 | A | | 5/1986 | Ikeda | |
| 4,729,748 | A | * | 3/1988 | Van Ruymbeke | 446/121 |
| 4,850,931 | A | | 7/1989 | Auer | |
| 5,163,861 | A | * | 11/1992 | Van Ruymbeke | 244/11 |

FOREIGN PATENT DOCUMENTS

| | | |
|---|---|---|
| DE | 1958011 | 7/1970 |
| DE | 2111148 | 9/1975 |
| DE | 2755786 | 6/1978 |
| FR | 1604345 | 11/1971 |
| FR | 2580944 | 10/1986 |
| GB | 1564900 | 4/1980 |

* cited by examiner

*Primary Examiner*—Derris H. Banks
*Assistant Examiner*—Bena B. Miller
(74) *Attorney, Agent, or Firm*—Wolf, Block, Schorr and Solis-Cohen, LLP

(57) ABSTRACT

The present invention relates to a winding device and a flying toy ornithopter device which employs the winding device. The flying toy ornithopter comprises a hollow body which simulates the appearance of a bird, insect or flying machine. A pair of wings are provided which oscillate, the wings are powered by the stored energy of a wound rubber band. One end of the rubber band is connected to a hook mounted in the tail of the hollow body, the other end of the rubber band is mounted to a winding device mounted near the head of the hollow body. The winding device comprises a frame which has a generally oval shape and conforms to the cross-sectional of the hollow body to mount therein, a central annular bore and a pair of lugs located at the periphery of the frame to which the wings are attached; a pin projects from the frame toward the front of the hollow body for the attachment of a locking lever.

14 Claims, 12 Drawing Sheets

WINDING DEVICE AND ORNITHOPTER UTILIZING SAME

This application claims the benefit of Provisional Application No. 60/186,118, filed Mar. 1, 2000.

FIELD OF THE INVENTION

The present invention relates to a winding device and a flying toy ornithopter device which employs the winding device.

SUMMARY OF THE INVENTION

The present invention relates to a winding device and a flying toy ornithopter device which employs the winding device. The flying toy ornithopter comprises a hollow body which simulates the appearance of a bird, insect or flying machine. A pair of wings are provided which oscillate, the wings are powered by the stored energy of a wound rubber band. One end of the rubber band is connected to a hook mounted in the tail of the hollow body, the other end of the rubber band is mounted to a winding device mounted near the head of the hollow body. The winding device comprises a frame which has a generally oval shape and conforms to the cross-sectional of the hollow body to mount therein, a central annular bore and a pair of lugs located at the periphery of the frame to which the wings are attached; a pin projects from the frame toward the front of the hollow body for the attachment of a locking lever.

DESCRIPTION OF THE PREFERRED EMBODIMENT

Figure 1:
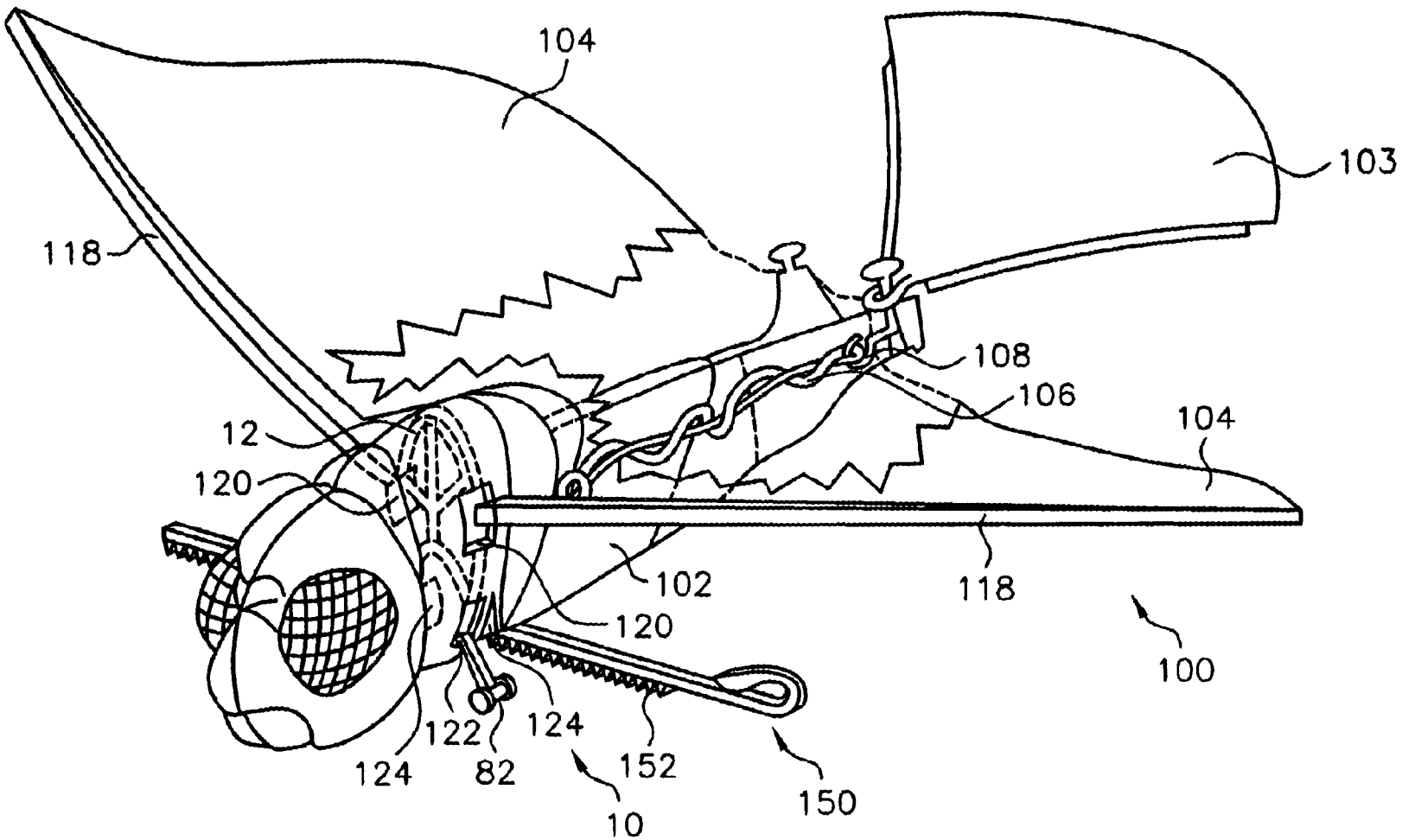
FIG. 1 is an isometric view of an illustrative ornithopter in accordance with an embodiment of the present invention.

Referring now to the drawings, the flying toy ornithopter 100 comprises a hollow body 102 which simulates the appearance of a bird, insect, or the like. The flying toy ornithopter 100 includes a tail wing 103 and a pair of wings 104 which oscillate up and down to simulate the flight of a bird or insect. The wings 104 are powered by the stored energy of a wound rubber band 106. One end of the rubber band 106 is connected to a hook 108 mounted in the tail of the hollow body 102. The other end of the rubber band 106 is mounted to the winding device 10 which is mounted near the head of the hollow body 102 and is described in greater detail below.

Figure 2:
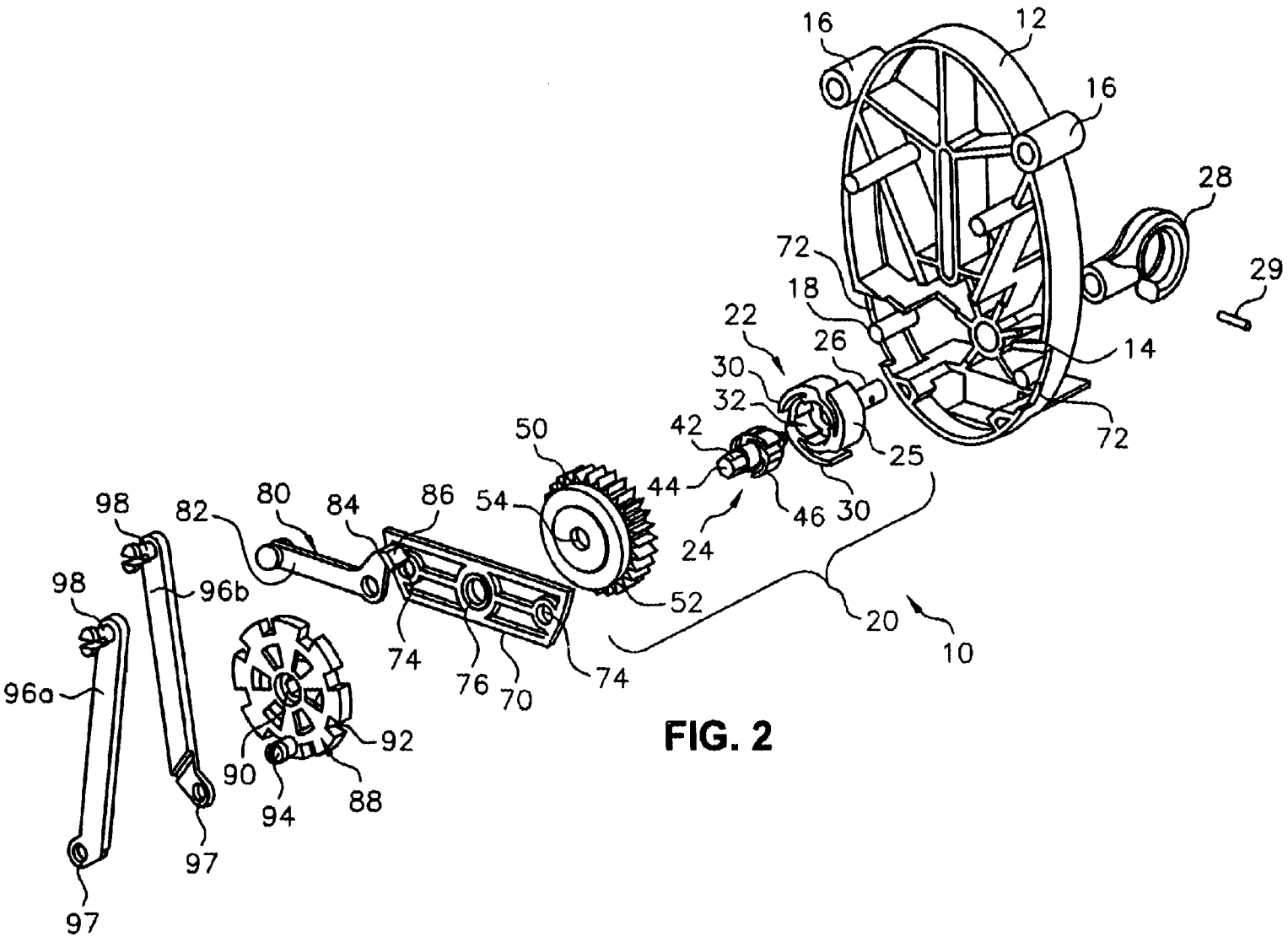
FIG. 2 is an exploded isometric view of the winding device of the ornithopter of FIG. 1 in accordance with an embodiment of the present invention.
Figure 3:
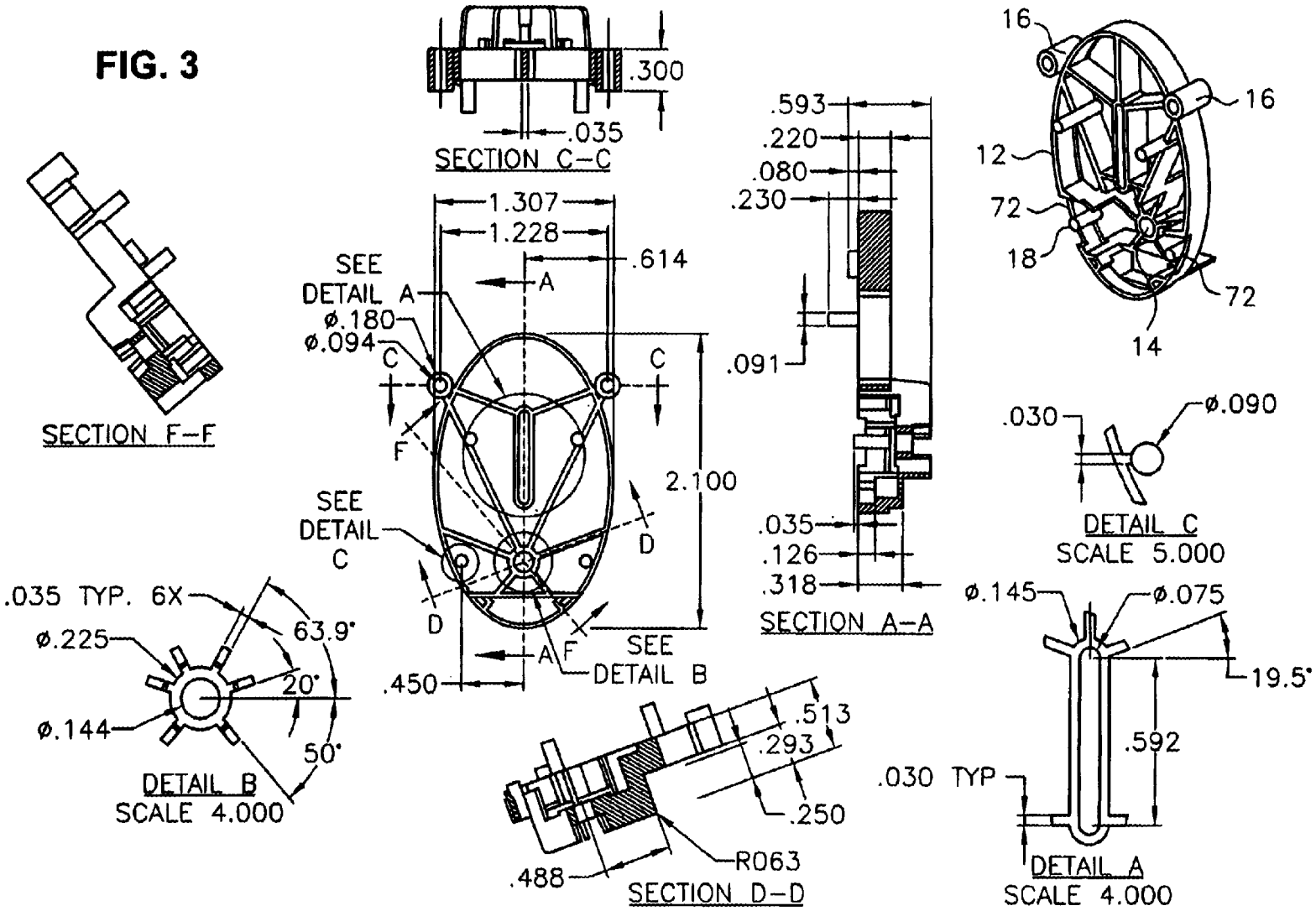
FIG. 3 is an isometric view of the frame of the winding device of the ornithopter of FIG. 1 in accordance with an embodiment of the present invention.

As best seen in FIGS. 1–3, the winding device 10 comprises a frame 12 which has a generally oval shape and conforms to the cross-sectional of the hollow body 102 to mount therein. The frame 12 includes a central annular bore 14 and a pair of lugs 16 located at the periphery of the frame to which the wings 104 are attached. A pin 18 projects from the frame 12 toward the front of the hollow body 102 for the attachment of a locking lever.

A clutch mechanism 20 is rotatably mounted in the central bore 14. The clutch mechanism 20 comprises an outer rubber band winding clutch 22, an inner wing drive clutch 24, and a gear wheel 50.

Figure 4:
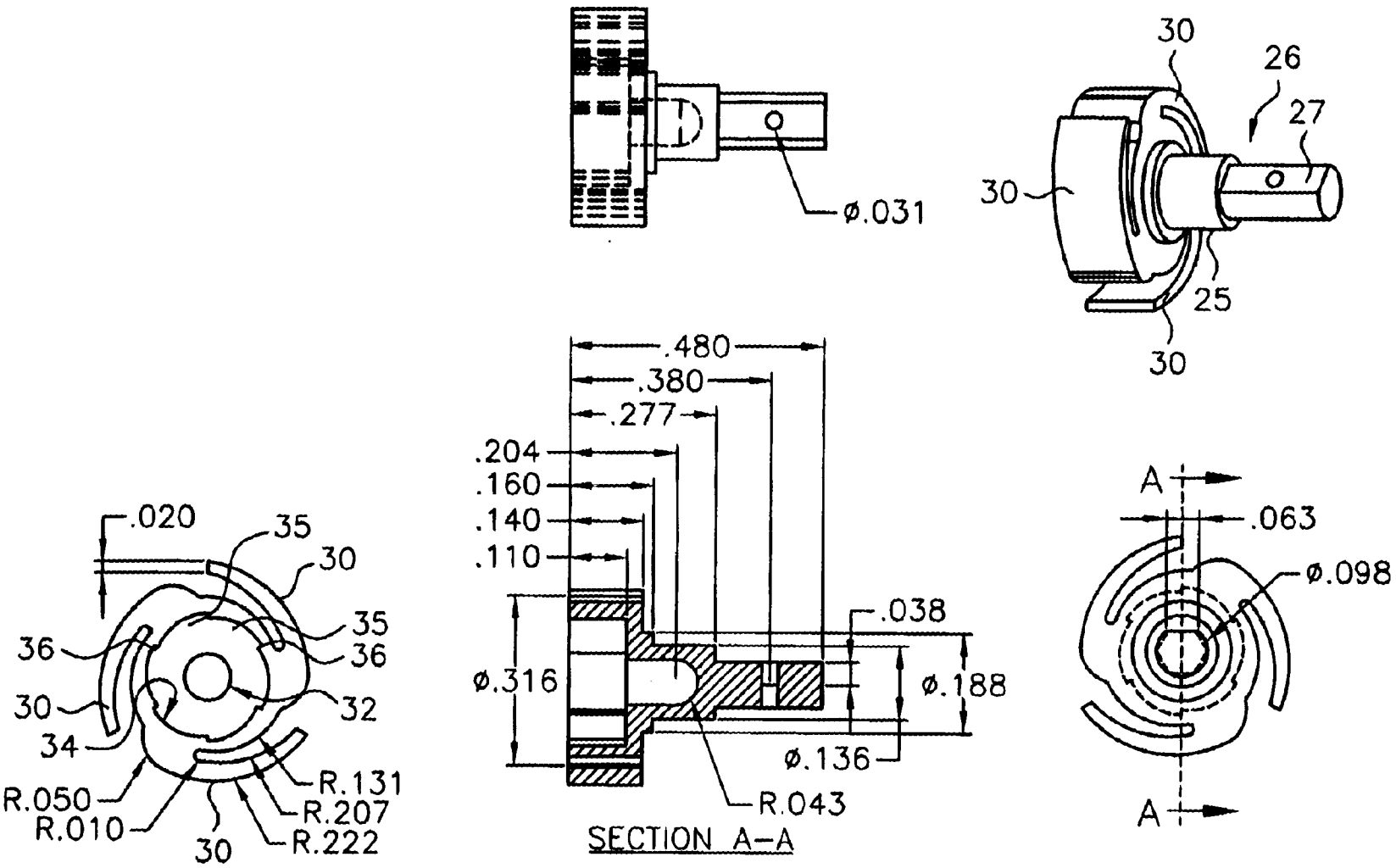
FIG. 4 is an isometric view of the outer clutch of the winding device of the ornithopter of FIG. 1 in accordance with an embodiment of the present invention.
Figure 5:
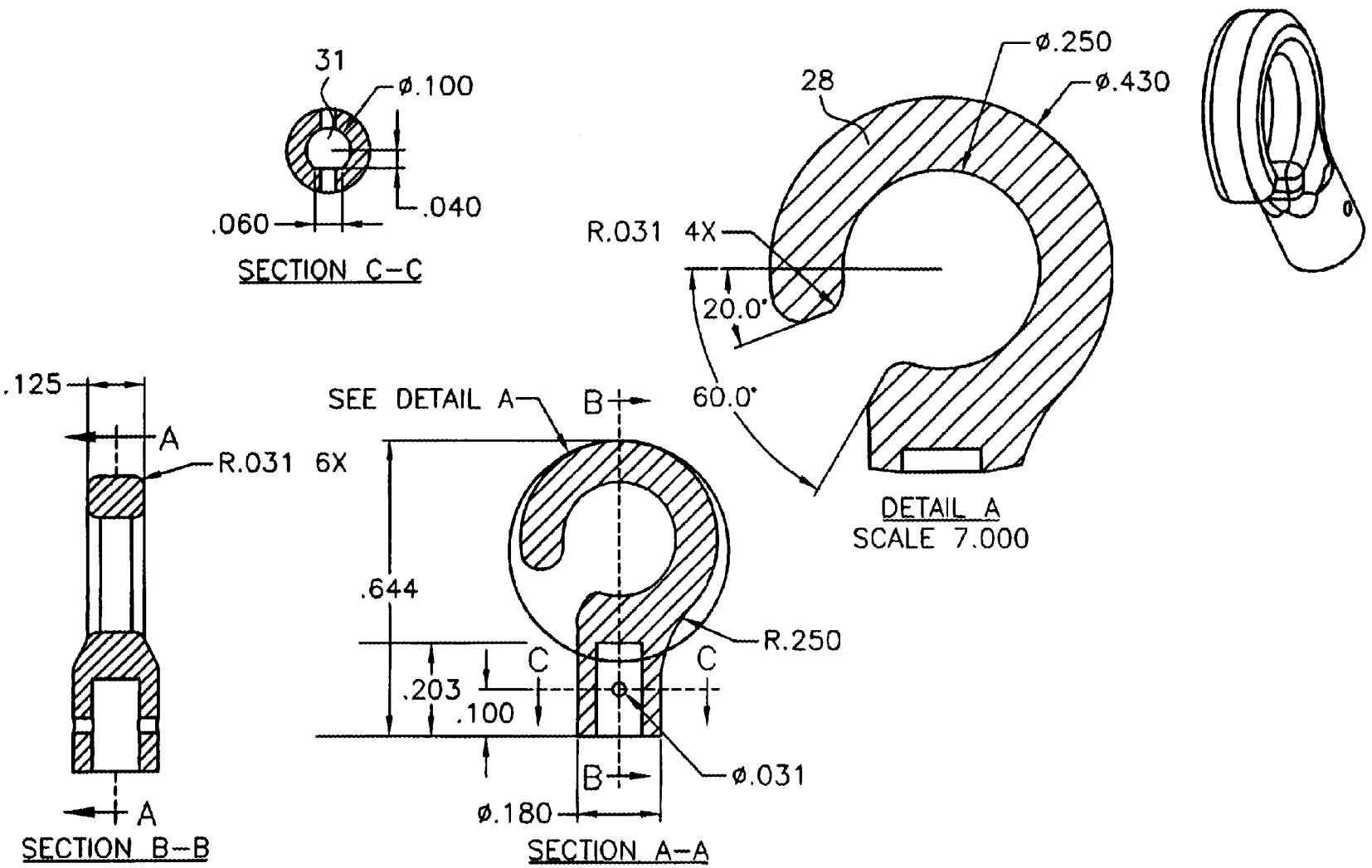
FIG. 5 is an isometric view of the rotating band catch of the winding device of the ornithopter of FIG. 1 in accordance with an embodiment of the present invention.

As best seen in FIGS. 1 and 4, the outer clutch 22 includes a body 25 and pin 26 protrudes from the back face of the clutch body 25 The pin 26 functions as a drive shaft which rotates within the central bore 14 of the frame 12 and connects to the rubber band motor 106. When the outer clutch 22 is mounted in the central bore 14, the shaft 26 protrudes from the back face of the frame 12 such that a rotating band catch 28 can be connected to the end of the shaft 26 by any suitable connection such as a cotter pin 29. As best seen in FIG. 5, the rotating band catch 28 is shaped like a hook for engaging an end of the rubber band 106. The shaft 26 has a flattened land 27 which engages with a similarly shaped asymmetrical opening 31 in the band catch 28.

The outer clutch 22 has a generally disc-like shape. A plurality of followers 30 extend from the axial side walls of the outer clutch 22. An annular cavity 32 is formed in the body 25 of the outer clutch 22 and is concentric with the shaft 26. The axial walls of the cavity 32 have a camming surface 34. The camming surface 34 has a plurality of curved portions 35 which terminate in stops 36 (best seen in FIG. 4).

Figure 6:
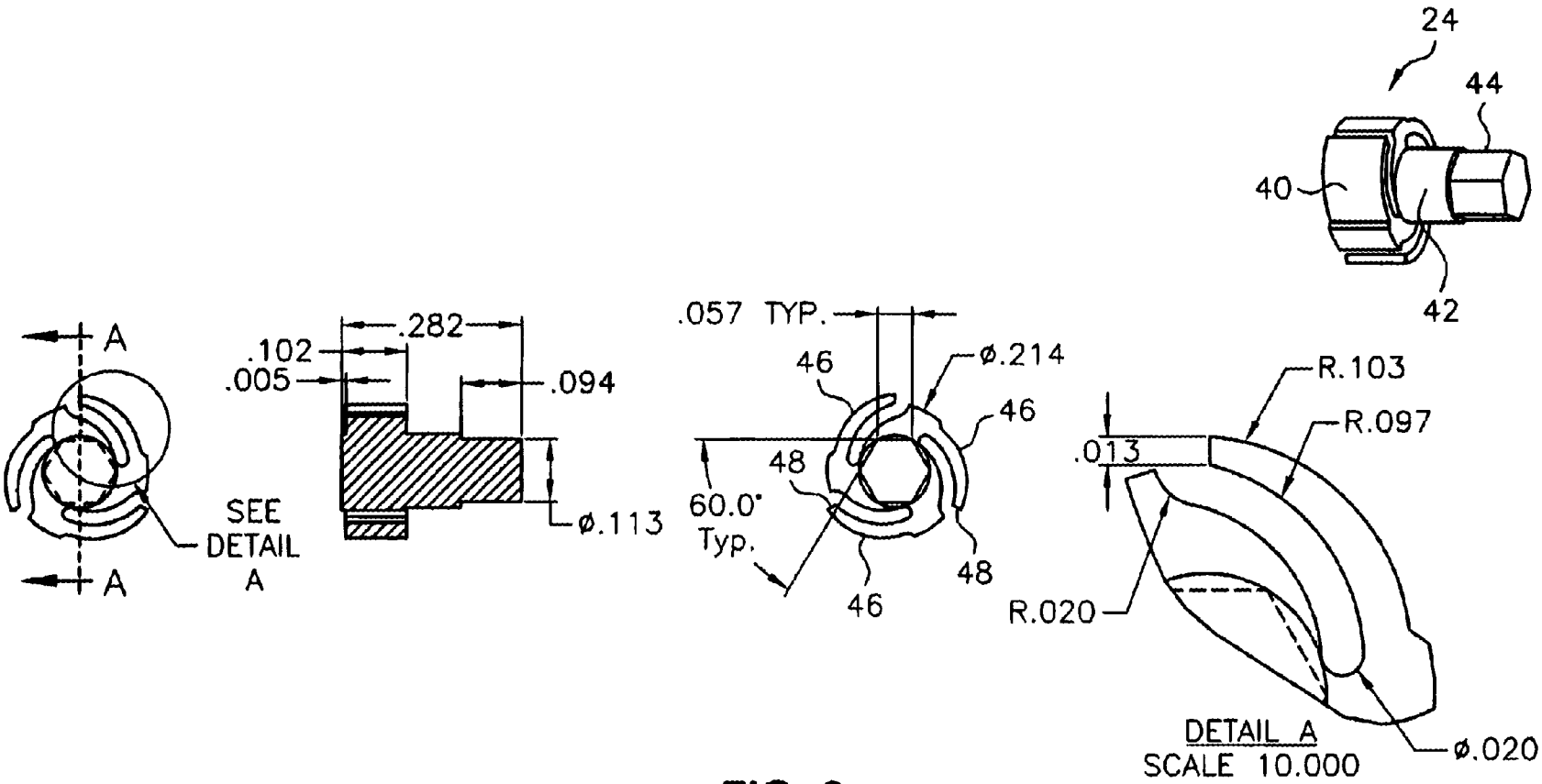
FIG. 6 is an isometric view of the inner clutch of the winding device of the ornithopter of FIG. 1 in accordance with an embodiment of the present invention.

As best seen in FIGS. 2 and 6, the inner clutch 24 is sized to fit within the cavity 32 of the outer clutch 22. The inner clutch 24 comprises a body 40 and a shaft 42 which extends from the front surface thereof. The shaft 42 has a hexagonal shaped end 44. The body 40 of the pin 42 has a plurality of followers 46 which extend from the axial wall thereof. The followers 46 are sized and shaped to engage with the camming surface 34 of the outer clutch 22 such that the inner clutch 24 will rotate counterclockwise, but will slip in the clockwise direction. As best seen in FIG. 6, this action is effected by the tips 48 of the followers 46 which engage a stops 36 of the camming surface 34. In addition, the outer surface of each follower 46 has a curved-shape with a diameter of curvature which is similar to the curved portions 35 of the camming surface 34. In this way, the curved followers 46 slip along the complementary curved surface 35 of the camming surface 34 of the outer clutch 22 when rotated in the clockwise direction.

Figure 7:
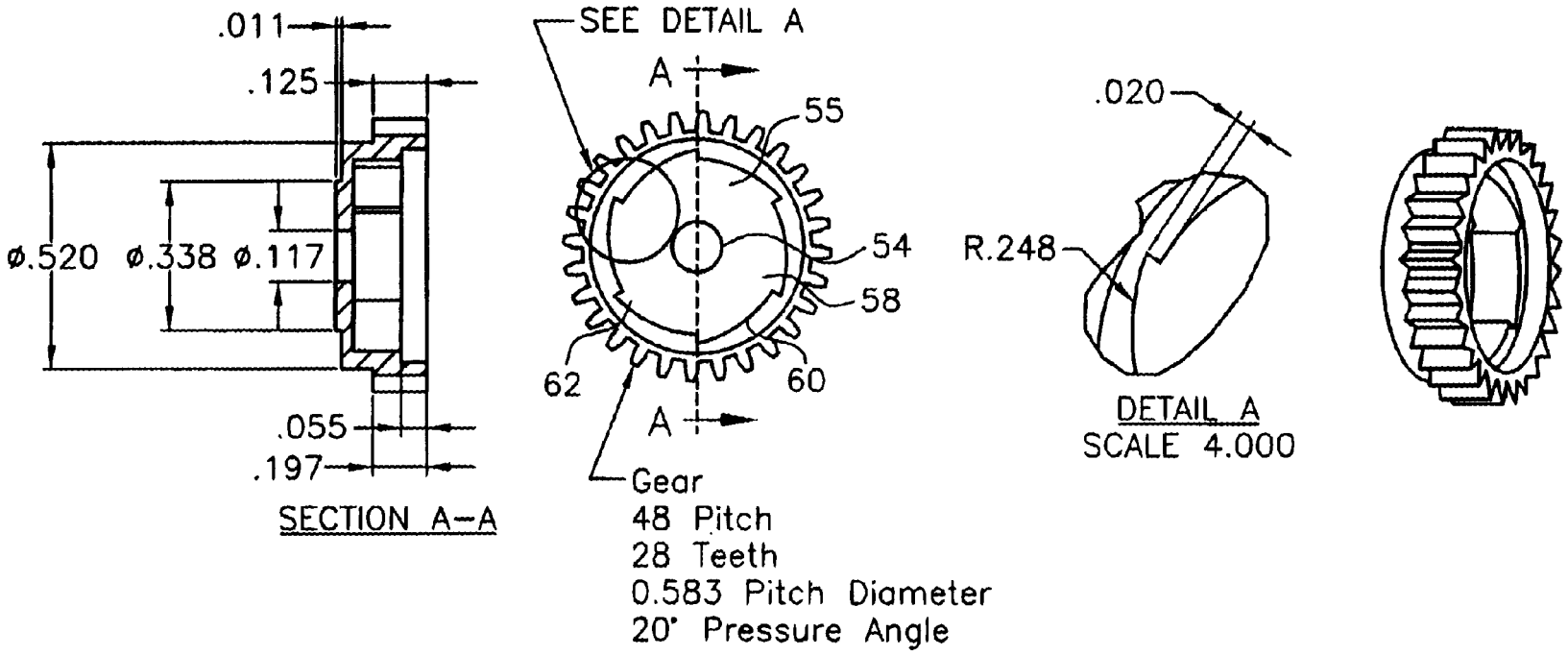
FIG. 7 is an isometric view of the gear wheel of the winding device of the ornithopter of FIG. 1 in accordance with an embodiment of the present invention.

As best seen in FIGS. 2 and 7, the clutch mechanism 20 further includes a gear wheel 50 having a series of gear teeth 52 extending around the outer axial wall thereof. The gear wheel 50 is provided with a central bore 54 for receiving the shaft 42 of the inner clutch 24. An inner cavity 55 is formed in the body of the gear wheel 50 and has a generally annular shape. The peripheral wall of the inner cavity 55 is provided with a camming surface 58 having curved portions 60 and stops 62 similar to the cavity 32 of the outer clutch 22. The outer clutch 22 fits within the inner cavity 55 and functions in a similar manner as described in connection with the inner clutch 24 in cavity 32 with the exception that the outer clutch 22 rotates in the clockwise direction and slips in the counterclockwise direction.

Figure 8:
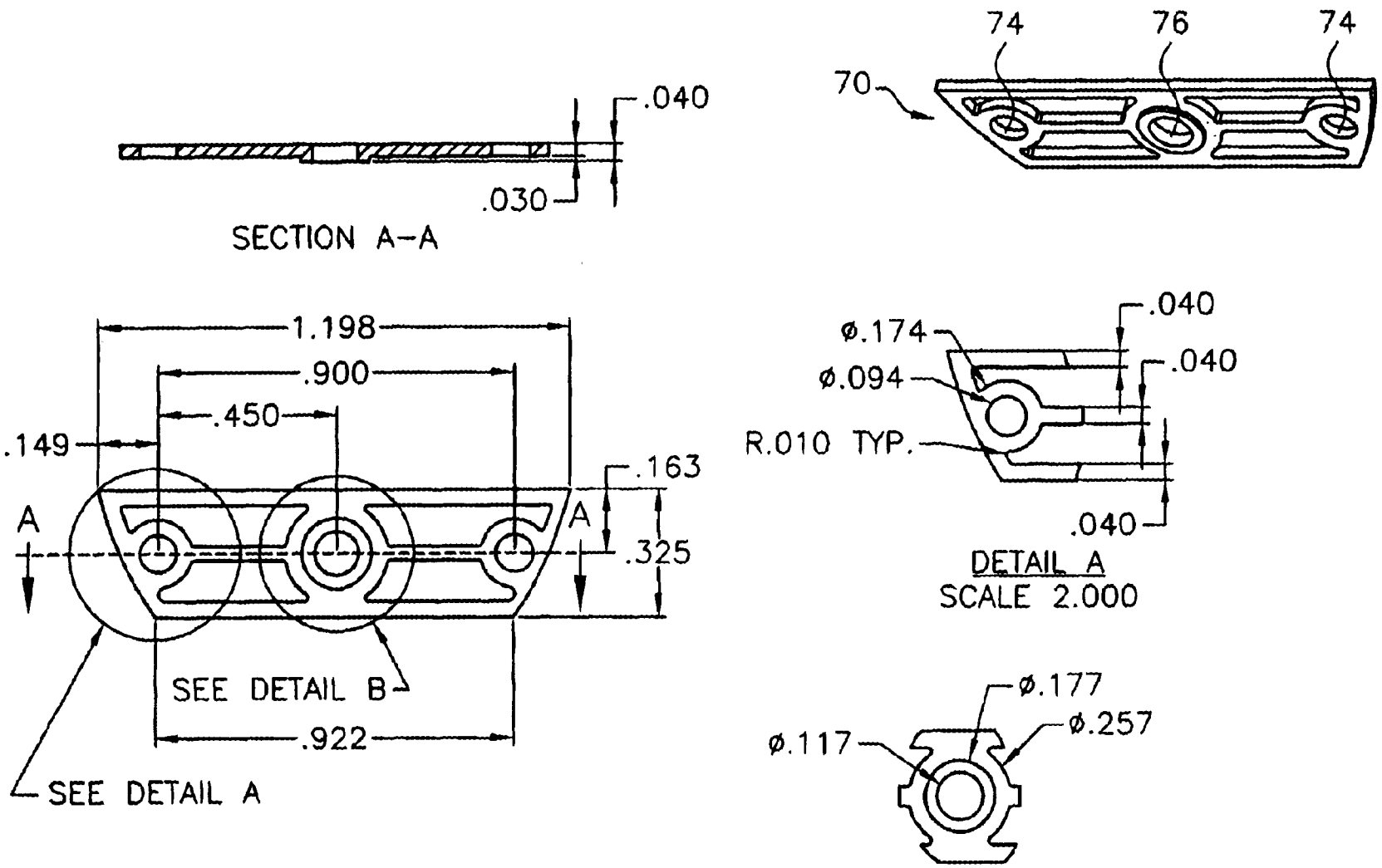
FIG. 8 is an isometric view of the elongated retainer of the winding device of the ornithopter of FIG. 1 in accordance with an embodiment of the present invention.

As best seen in FIGS. 2 and 8, an elongated retainer 70 is mounted within a pair of notches 72 formed in the front face of the frame 12. The retainer 70 is provided with a pair of bores 74 located at the ends of the retainer 70 and engage with protruding pins 18 of the frame 12 for securing the retainer 70 to the frame 12. The retainer 70 is also provided with a central bore 76. The central bore 76 acts as a bushing for the shaft 42 of the inner clutch 24 which rotates therein.

Figure 9:
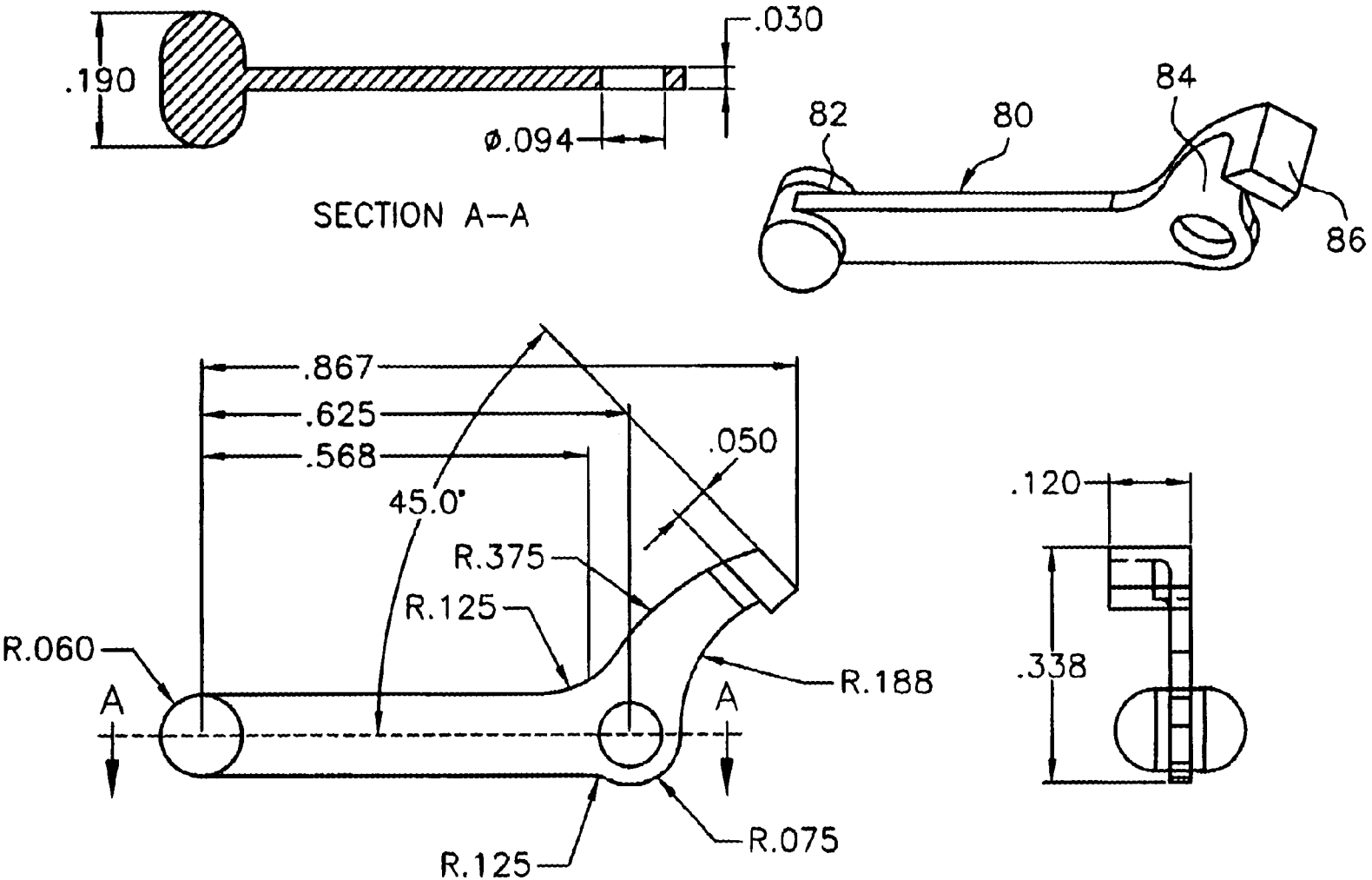
FIG. 9 is an isometric view of the stop lever of the winding device of the ornithopter of FIG. 1 in accordance with an embodiment of the present invention.

As best seen in FIGS. 2 and 9, a stop lever 80 is pivotably mounted on one of the pins 18 of the frame 12. One end 82 of the stop lever 80 serves as a manual actuator, while the other end 84 has a protruding tooth 86.

Figure 10:
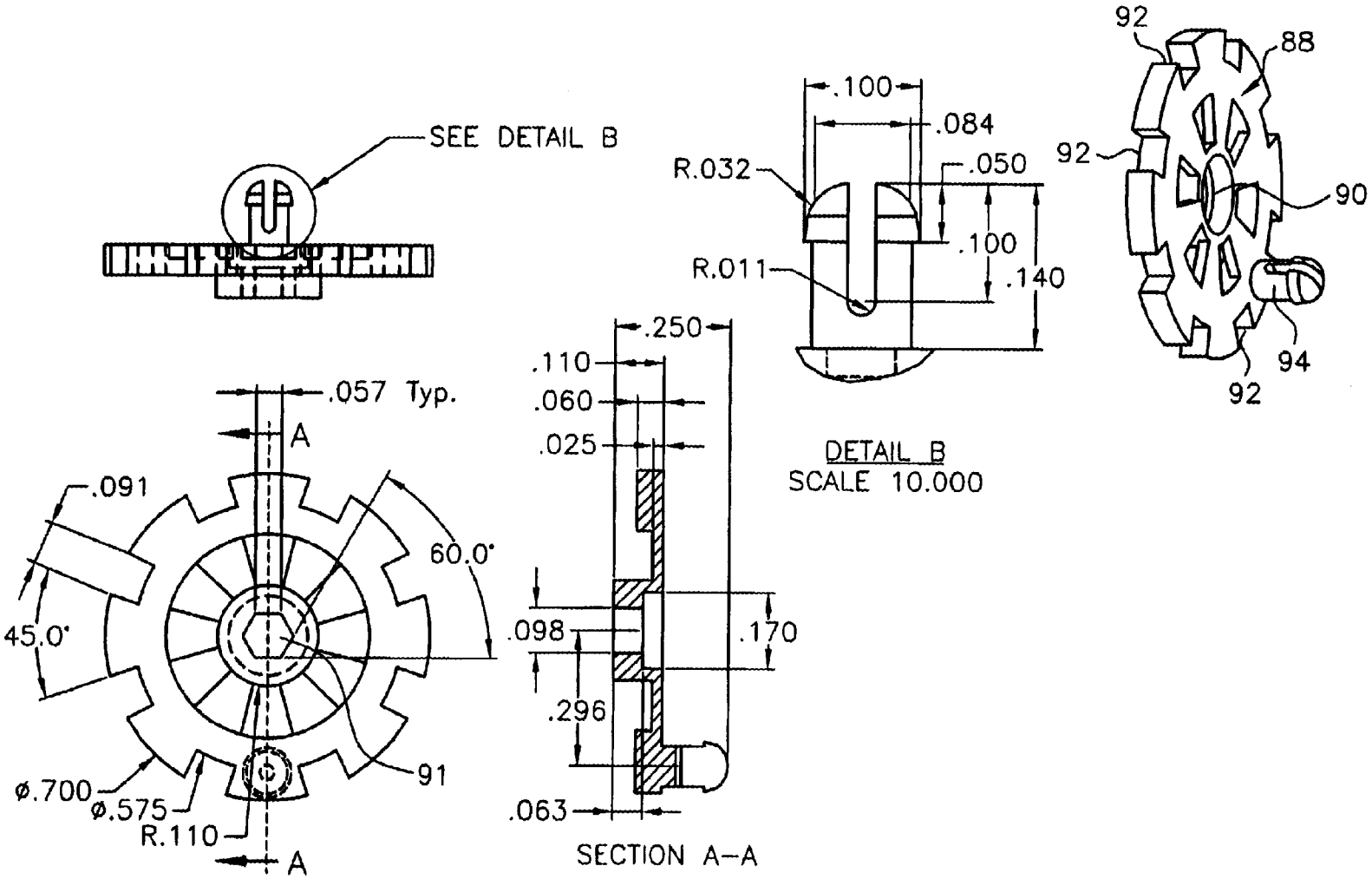
FIG. 10 is an isometric view of the clutch handle of the winding device of the ornithopter of FIG. 1 in accordance with an embodiment of the present invention.

As best seen in FIGS. 2 and 10, a disc-shaped clutch handle 88 is also mounted on the shaft 42 via a central bore 90 which has a hexagonal shape 91 to engage with the hexagonal lands 44 of shaft 42. A plurality of radial notches 92 are formed around the circumference of the clutch handle 88. The protruding tooth 86 of the stop lever 80 is sized to engage with the notches 92 for preventing rotation of the clutch handle 88 when so engaged. A pin 94 protrudes from the front face of the clutch handle 88 and is spaced radically outwardly from the center of the clutch handle 88.

As best seen in FIG. 2, the winding device 10 also includes a pair of connecting rods 96*a* and 96*b*. One end of each connecting rod 96 is provided with a bore 97 for connecting to the pin 94 of the clutch handle 88. The other end of each connecting rod 96 is provided with a protruding pin 98.

Figure 11:
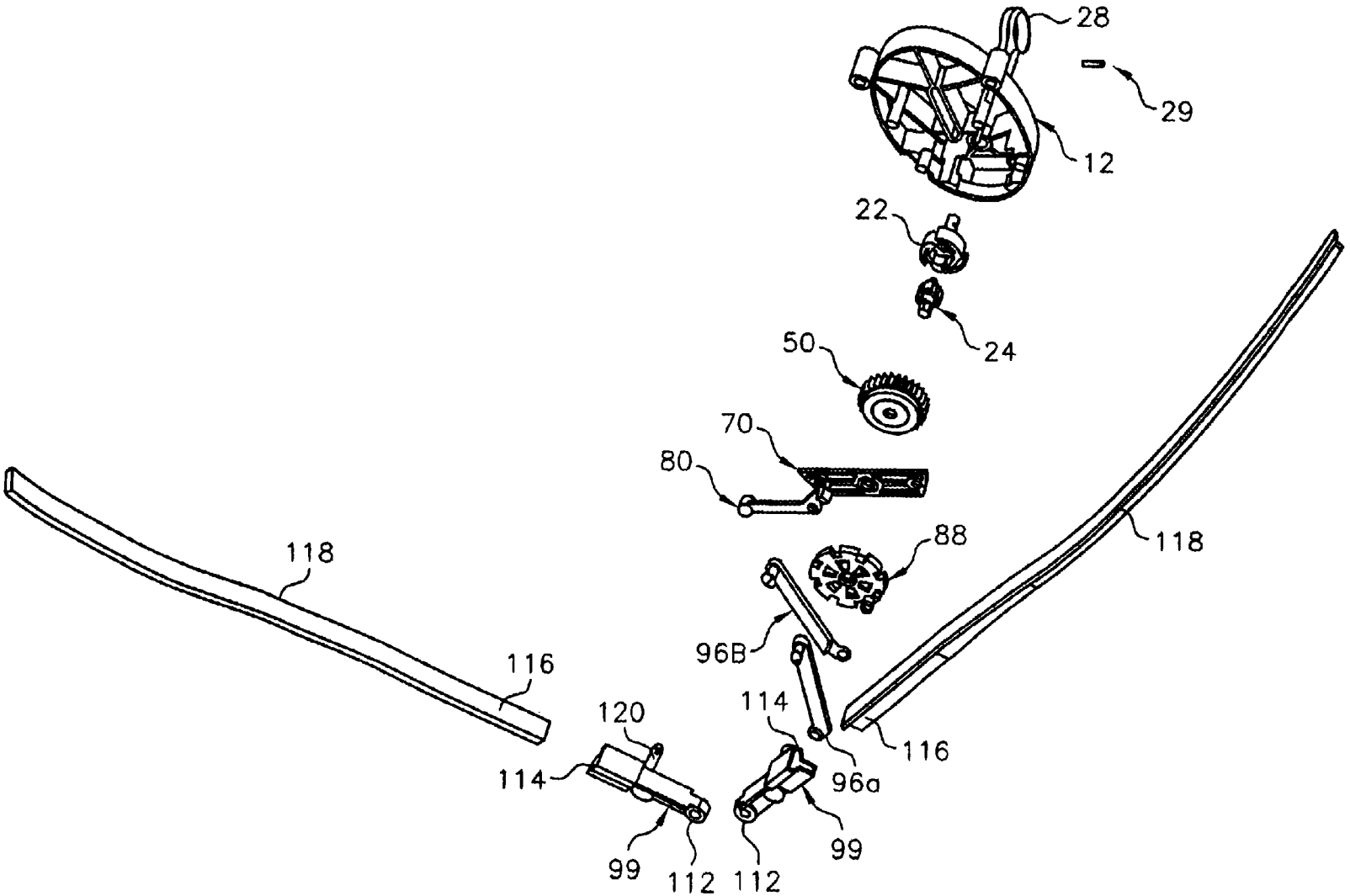
FIG. 11 is an exploded isometric view of the frame and wing pivots of the ornithopter of FIG. 1 in accordance with an embodiment of the present invention.

As best seen in FIG. 11, a pair of wing pivots 99 are pivotably attached to the bore 16 of the frame 12. The wing pivots 99 are provided with an intermediate pin 120 which engages with the bores 16. One end of each wing pivot 99 is provided with a bore 112 which engages with a pins 98 of one of the connecting rods 96*a* and 96*b*. The other end of the wing pivot 99 is provided with a T-shaped opening 114 which accepts a similar T-shaped end 116 of a wings frame 118 of wings 104.

When the clutch handle 88 is rotated on the shaft 42, the pin 94 rotates along with the clutch handle 88 in a circular motion. The circular motion of the pin 94 causes the connecting rods 96 to travel along with the pin 94 and converts the rotational movement of the clutch handle 88 to translational movement of the connecting rods 96. The translational movement of the connecting rods 96 cause the wing pivots 99 to pivot the wings 104 up and down to simulate the flapping of the wings of a bird or insect.

As best seen in FIG. 1, when the winding device 10 is mounted within the hollow body 102 of the ornithopter 100, each wing frame 118 protrudes through a pair of openings 120 in the hollow body. An opening 122 is also provided in the hollow body such that the actuator arm 82 of the stop lever 80 can protrude through the hollow body 102. In addition, a pair of openings 124 are provided in the vicinity of the gear wheel 50 such that a zip cord 150 can pass through the openings 124 and engage the gear teeth 52 of gear wheel 50.

Figure 12:
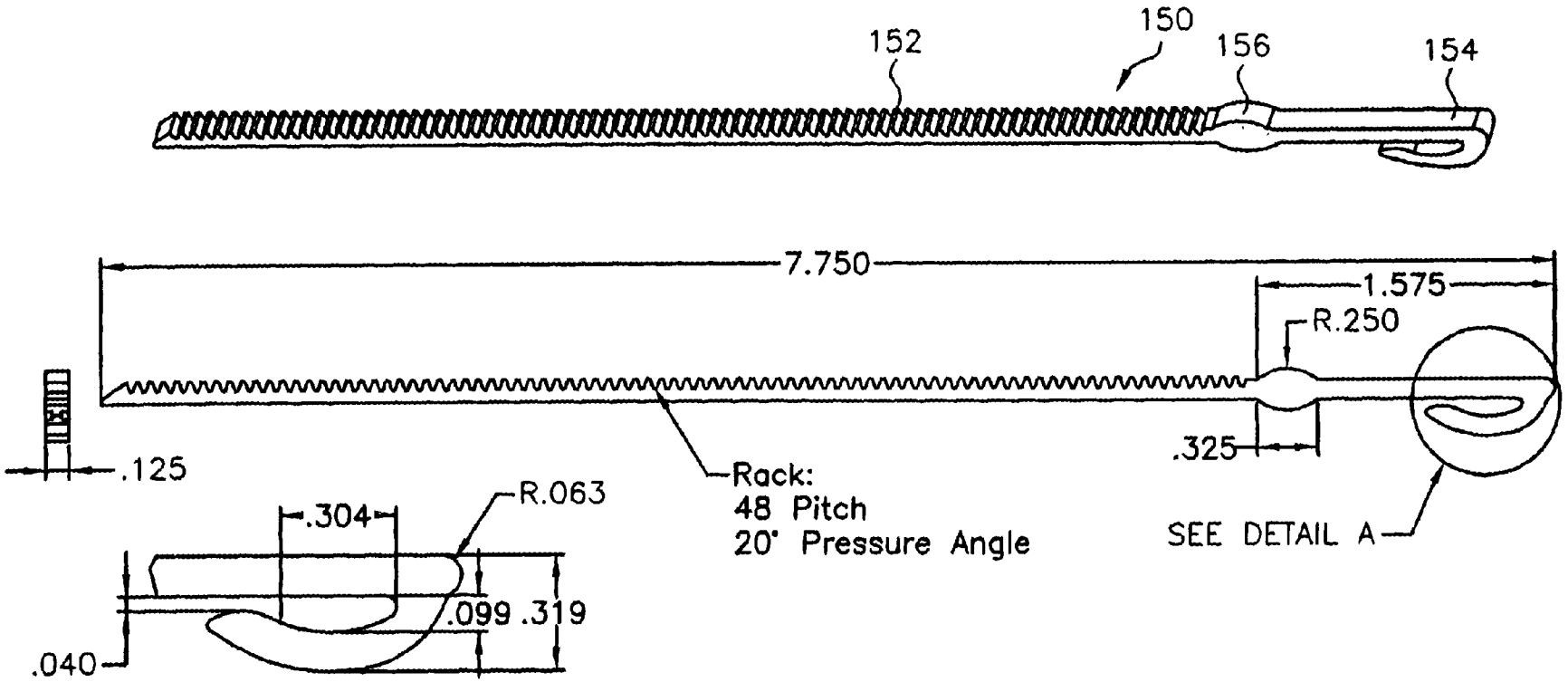
FIG. 12 is an isometric view of the zip cord of the winding device of the ornithopter of FIG. 1 in accordance with an embodiment of the present invention.

As best seen in FIG. 12, the zip cord 150 is provided with a series of gear teeth 152 along one side of the zip cord 150 for engaging with the gear teeth 52 of the gear wheel 50. The end of the zip cord 150 is provided with a handle 154 which allows a user to grasp the zip cord 150 and manipulate it. An enlarged stop block 156 is formed on the zip cord 150 to prevent the zip cord 150 from being inserted too far into the body 102.

The ornithopter 100 and winding device 10 operate as follows. Prior to winding the winding device 10, the wing frames 118 must be locked in place to prevent them from flapping up and down as the rubber band 106 is wound by the winding device 10. The wings 104 are locked in place by manually manipulating the wings such that they are in their fully upright position. The stop lever 80 is then manually rotated so that the protruding tooth 86 engages one of the teeth or notches 92 of the clutch handle 88, preventing the clutch handle 88 from rotating. When the clutch handle 88 is prevented from rotating, the wings 104 are prevented from oscillating up and down.

The zip cord 150 is inserted into one of the zip cord openings 124 in the hollow body 102. The gear teeth 152 of the zip cord 150 engaged with the gear teeth 52 of the gear wheel 50 and rotate the gear wheel 50 counterclockwise. This counterclockwise motion of the gear wheel 50 causes the camming surface 58 to slip past or slide over the followers 30 of the outer clutch 22. In this way, neither the rubber band drive shaft 26 nor the wing drive shaft 42 will rotate.

Now that the zip cord 150 is fully inserted into the hollow body 120, it can be pulled back out to effect the winding of the winding device 10. When the zip cord 150 is pulled, the teeth 152 engaged the teeth 52 of the gear wheel 50, rotating it clockwise. When the gear wheel 50 rotates clockwise, the stops 62 of the camming surface 58 engage with the ends of the followers 30 of the outer winding clutch 22 and rotate the outer winding clutch 22 clockwise along with the gear wheel

50. The rotation of the outer winding clutch 22 rotates the rubber band drive shaft 26, rotating the band catch 28. The rotation of the band catch 28 serves to wind the rubber band 106 which is attached to both the catch 28 and to the fixed hook 108 at the tail of the hollow body 102. In this way, energy is stored in the rubber band 106.

It is contemplated that each push/pull cycle of the zip cord 150 will result in about three revolutions of the rubber band 106. The rubber band would be sized such that approximately 15–20 push/pull cycles of the zip cord 150 will wind the rubber band 106 by an amount sufficient to store energy in the rubber band to oscillate the wings a predetermined number of times.

The clockwise rotation of the outer clutch 22 causes the inner drive clutch 24 to slip because the follower 46 of the inner drive clutch 24 slides past the camming surface 34 of the outer winding clutch 22. Since the inner clutch 24 slips when the outer clutch 22 is rotated clockwise, the wing drive shaft 42 does not rotate when the rubber band 106 is being wound. Upon the final push/pull stroke of the zip cord 150, the zip cord 150 is full retracted from the hollow body 102 and the rubber band 106 contains its maximum designed stored energy potential.

The wings 104 can be caused to flap or oscillate by actuating the stop lever 80 by manipulating the manual actuator 82, causing the stop lever 80 to pivot and the tooth 86 to disengage from the notches 92 of the clutch handle 88. Now that the clutch handle 88 is allowed to rotate freely, the wings will oscillate when the wing drive shaft 42 is driven by the wound rubber band 106.

The wound rubber band 106 rotates the band catch 28, rotating the outer clutch 22 in the counterclockwise direction and causing the stops 36 of the camming surface 34 of the outer clutch 22 to engage with the ends of the follower 46 of the inner clutch 24. The rotation of the inner clutch 24 rotates the wing drive shaft 42 which rotates the clutch handle 88. The rotation of the clutch handle 88 causes the wings to oscillate up and down via the connecting rods 96. In this way, the ornithopter device 100 can simulate the flapping of wings of a bird, insect, or the like.

The use of the slip clutch device 20 allows for a compact fabrication of the winding device and keeps the weight of the ornithopter device at a minimum which achieves a superior flying action. Although the zip cord 150 is the preferred way to wind the device, it is possible to employ a string to wind the rubber band in conjunction with a spring-loaded rotating wheel.

While the invention has been described in connection with the preferred embodiment, it is not intended to limit the invention to a particular form set forth, but, to the contrary, it is intended to cover such alternatives, modifications, and equivalence, as may be included within the spirit and scope of the invention, as defined by the appended claims.

What is claimed is:

1. A flying toy ornithopter comprising:

a hollow body simulating the appearance of a bird, insect or flying machine;

a pair of wings, the wings are capable oscillating and are powered by the stored energy of a wound rubber band;

one end of the rubber band is connected to a hook mounted in a tail of the hollow body, the other end of the rubber band is mounted to a winding device mounted near a head of the hollow body;

the winding device comprises a frame having a generally oval shape and conforming to the cross-sectional of the hollow body to mount in the cross-sectional, a central annular bore and a pair of lugs located at the periphery of the frame the wings being attached to the lugs; and a pin projecting from the frame toward the front of the hollow body for the attachment of a locking lever, and a clutch mechanism rotatably mounted in the central bore and comprising an outer rubber hand winding clutch, an inner wing drive clutch, and a gear wheel.

2. The ornithopter according to claim 1, wherein the outer clutch includes a body and a drive shaft protrudes from a back face of the clutch body, the drive shaft rotating within the central bore of the frame and connecting to the rubber band.

3. The ornithopter according to claim 2, wherein the winding device further includes a rotating band catch connected to the end of the outer clutch drive shaft for engaging an end of the rubber band.

4. The ornithopter according to claim 3, wherein a plurality of followers extend from axial side walls of the outer clutch, an annular cavity is formed in the body of the outer clutch and is concentric with the outer clutch drive shaft, axial walls of the cavity have a camming surface, and the camming surface has a plurality of curved portions terminating in stops.

5. The ornithopter according to claim 4, wherein the inner clutch is sized to fit within the cavity or the outer clutch, the inner clutch comprises a body and an inner clutch shaft extending from the front surface of the inner clutch, a plurality of followers extend from an axial wall of the inner clutch shaft, and the followers are sized and shaped to engage with a camming surface of the outer clutch.

6. The ornithopter according to claim 5, wherein tips of the inner clutch followers engage stops of the camming surface.

7. The ornithopter according to claim 6, wherein an outer surface or each of the followers has a curved-shape with a diameter of curvature similar to curved portions of the camming surface of the outer clutch, and curved followers of the inner clutch slip along a complementary curved surface of the camming surface of the outer clutch when rotated in one direction.

8. The ornithopter according to claim 7, wherein the clutch mechanism further includes a gear wheel having a series of gear teeth extending around an outer axial wall of the gear wheel, the gear wheel includes a central bore for receiving the shaft of the inner clutch, and an inner cavity is formed in the body of the gear wheel and has a generally annular shape.

9. The ornithopter according to claim 8, wherein a peripheral wall of the inner cavity is provided with a camming surface having curved portions and stops and the outer clutch fits within the inner cavity.

10. A winding device comprising:

a flame having a generally oval or round shape;

a central annular bore and a pair of lugs located at the periphery of the frame, movable members being attached to the lugs;

a pin projecting from the frame for the attachment of a locking lever;

a clutch mechanism rotatably mounted in the central bore the clutch mechanism comprising an outer rubber band winding clutch, the outer clutch including a body and a drive shaft protruding from a back face of the clutch body, the drive shaft rotating within the central bore of tie frame and connecting to the rubber band, an inner movable member drive clutch, and a gear wheel;

a rotating band catch connected to the end of the outer clutch drive shaft for engaging in end of the rubber hand;

wherein a plurality of followers extend from axial side walls of the outer clutch, an annular cavity is formed in the body of the outer clutch and is concentric with the outer clutch drive shaft, axial walls of the cavity have a camming surface, the camming surface has a plurality of curved portions terminating in stops, the inner clutch is sized to fit within the cavity of the outer clutch, the inner clutch comprises a body and an inner clutch shaft extending from a front surface of the inner clutch, a plurality of followers extend from an axial wall of the inner clutch shaft, the followers are sized and shaped to engage with the camming surface of the outer clutch.

11. The winding device according to claim 10, wherein tips of the inner clutch followers engage stops of the camming surface.

12. The winding device according to claim 11, wherein the outer surface of each of said followers has a curved-shape with a diameter of curvature similar to a curved portions of the camming surface of the outer clutch, the curved followers of the inner clutch slip along the complementary curved surface of the camming surface of the outer clutch when rotated in one direction.

13. The winding device according to claim 12, wherein the clutch mechanism further comprises a gear wheel having a series of gear teeth extending around the outer axial wall of the gear wheel, the gear wheel includes a central bore for receiving the shaft of the inner clutch, and an inner cavity is formed in the body of the gear wheel and has a generally annular shape.

14. The winding device according to claim 13, wherein a peripheral wall of the inner cavity is provided with a camming surface having curved portions and stops and the outer clutch fits within the inner cavity.

* * * * *